United States Patent [19]

Caenazzo et al.

[11] Patent Number: 4,766,802

[45] Date of Patent: Aug. 30, 1988

[54] SMALL-SIZED ENGINE OPERATED BY FLUID

[76] Inventors: Alessandro Caenazzo; Silvana Pasqualotto, both of Via Vittorio Veneto 79, 31020 S.Vendemiano (TV), Italy

[21] Appl. No.: 30,622

[22] Filed: Mar. 27, 1987

[30] Foreign Application Priority Data

Mar. 28, 1986 [IT] Italy ..... 83338 A/86

[51] Int. Cl.[4] ..... F15B 15/22; F20B 75/04

[52] U.S. Cl. ..... 91/394; 91/24; 91/25; 91/392; 91/397; 91/402; 91/404; 92/89; 123/48 A; 137/627.5

[58] Field of Search ..... 92/89; 91/24, 25, 394, 91/397, 402, 357, 404, 235, 241, 314, 265, 325, 321, 417; 123/193 P, 48 A; 137/627.5, 859

[56] References Cited

U.S. PATENT DOCUMENTS

| | | | |
|---|---|---|---|
| 1,266,252 | 5/1914 | Hadford | 92/89 |
| 2,588,478 | 3/1952 | Brown, III et al. | 91/325 |
| 3,473,329 | 10/1969 | Eggstein | 60/562 |
| 3,703,848 | 11/1972 | Brown | 91/265 |
| 3,995,535 | 12/1976 | Ozechowski | 92/89 |
| 4,190,024 | 2/1980 | Davis | 123/48 A |

FOREIGN PATENT DOCUMENTS

| | | | |
|---|---|---|---|
| 2024427 | 2/1971 | Fed. Rep. of Germany | 137/859 |
| 2018366 | 10/1979 | United Kingdom . | |
| 2912556 | 2/1980 | United Kingdom . | |
| 2029908 | 3/1980 | United Kingdom . | |
| 355350 | 10/1928 | U.S.S.R. . | |

*Primary Examiner*—Robert E. Garrett
*Assistant Examiner*—Thomas E. Denion
*Attorney, Agent, or Firm*—Wegner & Bretschneider

[57] ABSTRACT

Small-sized engine operated by an expanding gaseous fluid, which comprises a cylinder (18), a piston (20) and an inlet valve (38), the upper parts of the cylinder (18) and the piston (20) cooperating momentarily with a perforated (29) resilient membrane (28) circumferentially secured to the cylinder (18) and performing the functions of a pneumatic seal temporarily.

11 Claims, 5 Drawing Sheets

SMALL-SIZED ENGINE OPERATED BY FLUID

This invention concerns a small-sized engine operated by fluid and concerns in particular a small-sized engine suitable to be actuated by the energy of a gaseous fluid under pressure, such as air, carbon dioxide, a halogenated hydrocarbon such as FREON or another gas which can be employed for the purpose.

A small-sized engine of such a type is applied correctly to model aircraft, the movement of toys, scale models, small mechanisms and tools, fans, etc.

Small internal-combustion engines, small electric motors, motors driven by a spring or elastic means and also small motors or engines driven by a fluid are normally used to move models, toys, etc. as indicated above.

Small motors driven by a fluid are known in themselves.

Thus, GB No. 2,029,908 discloses a small fluid-operated motor which employs a complex structure to perform all the functions required for the working of the motor with an acceptable cost and efficiency.

U.S. Pat. Nos. 2,588,478 and 3,703,848 disclose small fluid-operated engines which are very simple but of which the efficiency is unsatisfactory for use. These small engines have to be fed with high-pressure fluids which are difficult to move and handle and are, above all, dangerous.

DE No. 2.912.556 concerns substantially a small-sized engine of the type dealt with in the above two US patents. This patent corresponds to GB No. 2,018,366 and provides for the exhaust valve to be actuated by a prong protruding from the crown of the piston.

All the known small fluid-operated engines involve an unsatisfactory efficiency and high production costs because, owing to the measurements involved, which are very small and only of the order of some millimetres, the processing tolerances have to be very narrow, and this is difficult to produce, particularly in mass production.

Moreover, the small fluid-operated engines of known types, in order to maintain their efficiency, even in cases where the construction tolerances are correct, have to include a plurality of parts made of hard and valuable materials which require suitable lubrication so as to prevent such tolerances being modified by wear and the efficiency thus declining speedily.

Alternatively the known small engines require resilient sealing packings which provoke considerable wear between the piston and cylinder, to the detriment of the efficiency of the engine.

BE Pat. No. 355.350 discloses a motor operated by fluid under pressure and employing an exhaust valve controlled by the piston itself by means of a plunger lodged in the piston, such motor involving considerable constructional and functional complications.

U.S. Pat. No. 3,910,160 too employs exhaust valves actuated by small pistons governed by the head of the connecting rod; this embodiment entails not only great constructional complications but also dimensions which are such that they require motors of a considerable capacity.

U.S. Pat. No. 4,190,024 discloses a two-cycle diesel engine with an exhaust port of the type traditional in two-cycle engines.

The present invention tends to embody a small-sized fluid-operated engine of the type disclosed in U.S. Pat. No. 2,588,478 but suitable to work mainly at medium-low pressure without any particular lubrication problems and to be built with materials of no great value, such as plastics, for instance.

The invention tends also to embody a small-sized engine of which the components are suitable to be produced by molding or other method compatible with mass production without problems of very close tolerances.

The invention, therefore, has the purpose of obtaining also components with relatively wide processing and assembly tolerances.

According to the invention a resilient membrane is caused to cooperate with the upper crown of the piston and performs the function of a pneumatic seal against an expanding fluid during at least part of the expansion phase of the fluid, thus reducing consumption considerably.

In an evolutive variant of the invention, the storage chamber of the fluid under pressure can cooperate with a valve actuated, for instance, by the piston itself so as to enhance the effect of the fluid under pressure together with a suitable timing in relation to the top dead center position of the piston.

In another evolutive variant, the discharge of the expanded fluid at the end of the stroke of the piston can be obtained by means of appropriate radial slits machined on the piston which are left free at the correct moment by expansion of the hole in the resilient membrane.

In a further evolutive variant the discharge of the expanded fluid at the end of the stroke of the piston can take place by employing an appropriate automatic valve.

In yet another evolutive variant, the piston comprises a circumferential notch able to make the edge of the piston resilient. A better seal during the down stroke of the piston is produced with the cooperation of such resilient edge and the inner wall of the cylinder.

The invention is therefore embodied with a small-sized engine operated by an expanding gaseous fluid, which comprises a cylinder, a piston and an inlet valve and is characterized in that the upper parts of the cylinder and of the piston cooperate momentarily with a perforated resilient membrane circumferentially secured to the cylinder and performing the functions of a pneumatic seal temporarily.

The attached figures, which are given as a non-restrictive example, show the following:

Figure 1:
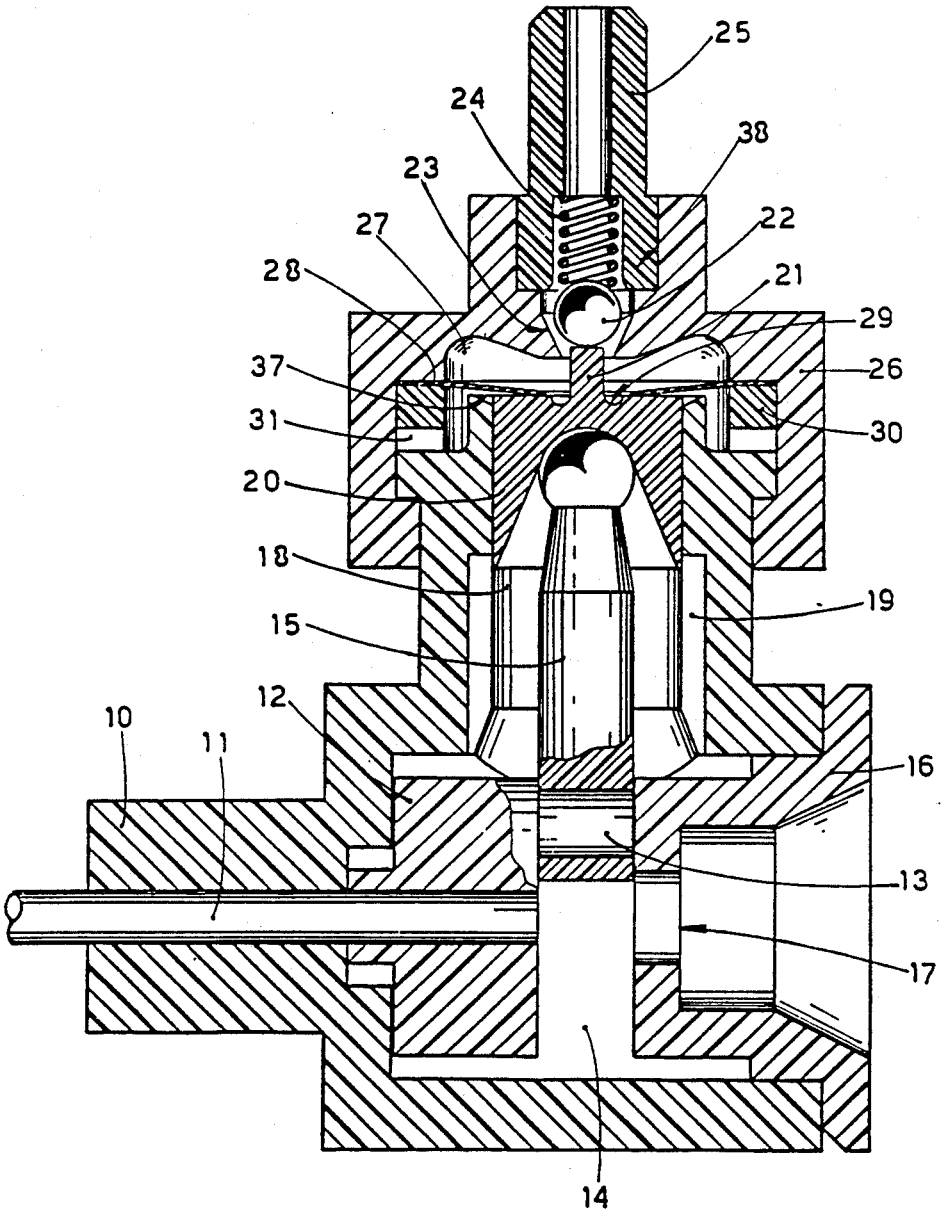
FIG. 1 is a lengthwise vertical section of a preferred small-sized engine according to the invention.
Figure 2:
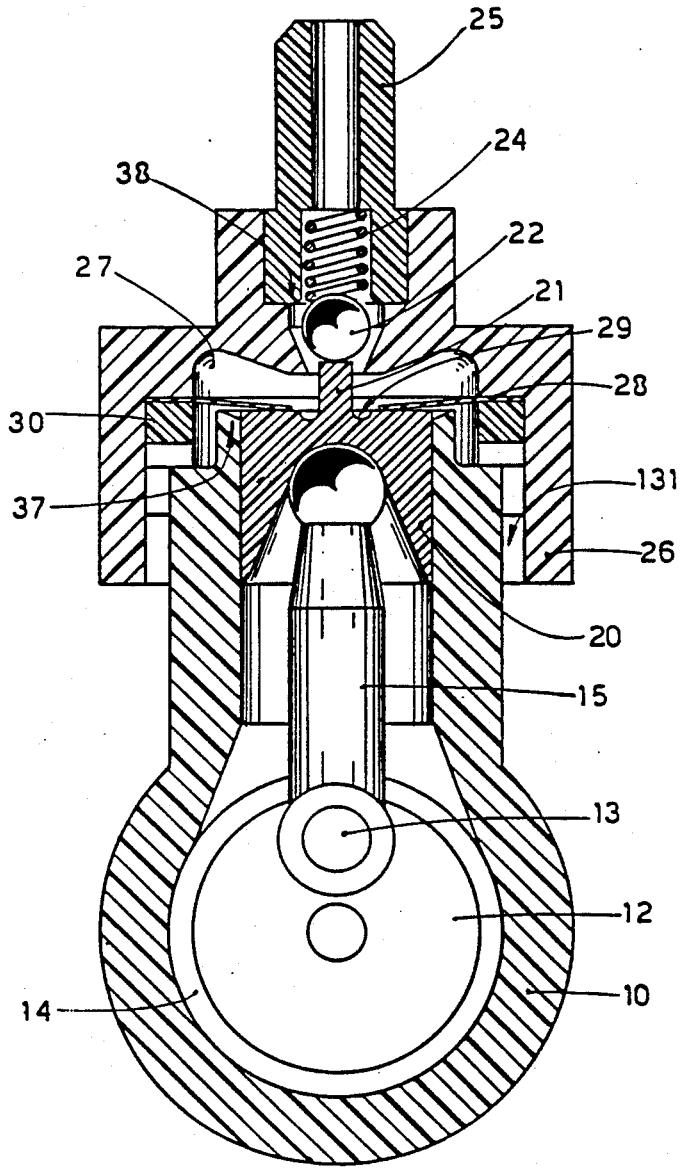
FIG. 2 shows the small-sized engine of FIG. 1 in a vertical section positioned at a right angle to the section of FIG. 1.

FIGS. 3, 4*a*, 4*b*, 5 and 6 show four further embodiments.

The present applicants have embodied the small engine shown in the figures with components made of molded plastics with the exceptions of a shaft 11, spring 24 and spherical ball 22, which in this caes consist of a metal, and of a membrane 28, which consists of a soft rubber, in this case silicone rubber, rubber latex, india rubber or another material possessing great resilience.

It should be noted that a piston 20 of the small engine can have a bore ranging from 4 up to 12–20 mm.; this is to show the dimensions involved and the resulting constructional and operating problems.

A base 10 supports a shaft 11 and contains a flywheel 12 in a crank case 14, the flywheel being integral with the shaft and having the function of a crank.

The flywheel 12 comprises a pin 13, to which a connecting rod 15 is keyed so as to be able to rotate.

The crank case 14 is closed by a cover 16 which may comprise an outlet hole 17.

The piston 20 slides in a cylinder 18, which includes outlets or exhaust ports 19 discharging to the outside atmosphere near the bottom dead centre position of the piston. The exhaust ports 19 are connected to the crank case 14 and outlet hole 17, and their inclusion makes it possible to obviate the easy entry of dirt into the cylinder 18.

At the upper end of the engine a cylinder head 26 cooperates with the base 10. The connection of the head to the base can be obtained in any known manner.

In this example a ring 30 is comprised in cooperation with the cylinder head 26 and upper part of the cylinder 18 and provides discharge passages 31 which lead to the exterior 131 in the cylinder head 26.

In the embodiment shown, the membrane 28, which here comprises a hole 29 at its center, is fixed between the ring 30 and cylinder 26 and will advantageously be slightly downwardly cambered at its center towards the piston 20.

The membrane 28 is made of a resilient material such as, for instance, a soft rubber, which may be silicone rubber, rubber latex, india rubber or another material possessing a great capacity of expansion in a substantially or completely resilient field.

A storage chamber 27 is positioned above the membrane 28.

The cylinder head 26 comprises an inlet valve 38, which in this example is operated in the neighborhood of the upper dead center position of the piston 20 by a projecting rod 21 fixed to the top of the piston, but the valve may be lodged elsewhere and be operated in a different manner.

In this example the valve 38 is opened by the projecting rod 21 when the latter has overcome the thrust of the spring 24 and has displaced the spherical ball 22 from a seating 23.

The method of working is simple. When the valve 38 has been opened, the fluid under pressure expands into the storage chamber 27, which is sealed because the membrane 28 rests on the upper crown of the piston 20.

While the shaft 11 continues rotating, the piston 20 descends, its descent travel being assisted by expansion of the fluid under pressure into the expansion chamber thus becoming available in the cylinder 18.

When the piston 20 descends, the membrane 28 rests on a support ring 37 located in the upper part of the cylinder 18 and continues to rest on the piston 20.

When the piston 20 descends still further, the membrane 28 is detached from the piston 20 owing to the attainment of an equilibrium between the pressure of the fluid and the resilience of the material composing the membrane but keeps the discharge passages 31-131 closed.

The piston descends yet further until it coincides with the exhaust ports 19. The gas pours out through the ports 19, the pressure in the expansion chamber falls substantially to zero and the membrane 28 returns fully to its inactive position, thus freeing the discharge passages 31, so that the upward travel of the piston 20 is facilitated since the expansion chamber is now at the ambient pressure.

Figure 3:
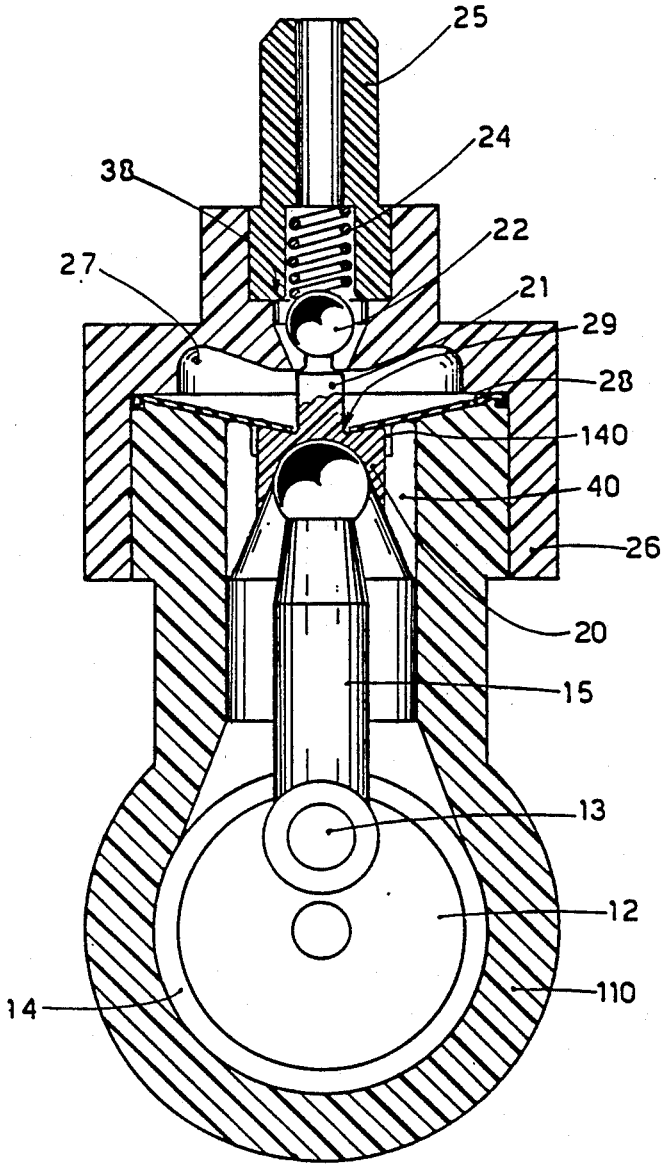
Figure 4B:
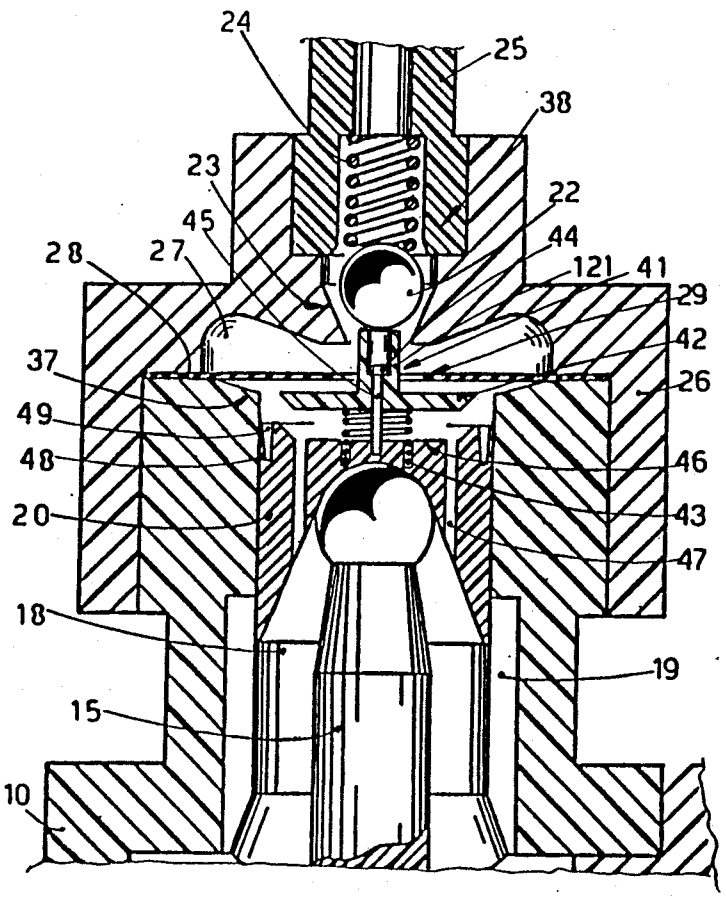
Figure 4A:
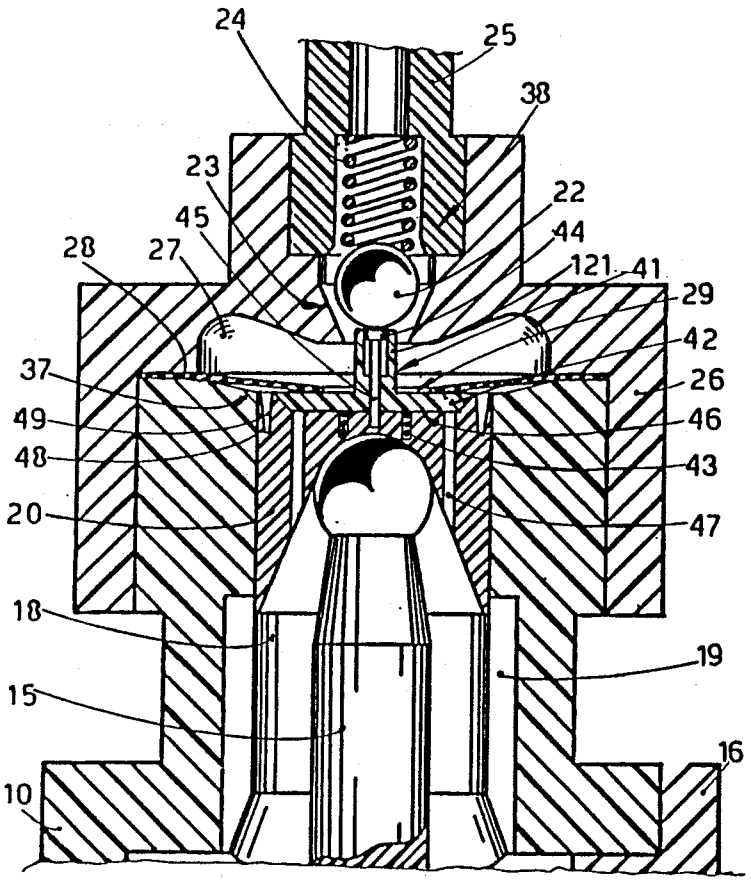

In the embodiment shown in FIG. 3 the exhaust ports 19, 31 and 131 in the stationary part of the engine are replaced by notches 40 machined radially on the piston 20.

When the central portion of the membrane 28 about the hole 29 expands as a result of the descent of the piston 20 and the enlargement of the expansion chamber, the notches 40 become uncovered, thus enabling the expanded fluid to escape with a consequent disappearance of the pressure in the expansion chamber and the return of the membrane 28 to its position of rest.

The upward stroke of the piston 20 is facilitated by the outflow of the fluid in the expansion chamber through the notches 40. An annular hollow 140 which units the notches 40 makes the discharge action more uniform.

In another embodiment an automatic valve 41 to discharge the expanded fluid is fitted to the crown of the piston 20 and opens when the pressure within the expansion chamber falls with the opening of the exhaust ports 19 or 40 at the end of the down stroke of the piston.

This automatic valve 41 consists of a plate 42 equipped with a hollow rod 121, which is thrust upwards by a spring 43 and retained by a head 44 of a pin 45. The seating of the valve 41 is machined on the crown of the piston 20, and the body of the piston includes some slots 47 which enable the expanded fluid to be discharged into the crank case 14.

Closure of the valve takes place in the neighborhood of the top dead center position of the piston when the hollow rod 121 meets the spherical ball 22 thrust by the spring 24 and by the pressure of the fluid being fed. Such closure is maintained until the thrust of the fluid in the expansion chamber overcomes the force of the thrust spring 43.

The embodiment of FIG. 4 arranged for the membrane 28 to accompany the stroke of the piston 20 along only a short tract of the same during maximum pressure, thus ensuring a complete seal.

In the successive tract of the stroke, where the pressure is lower, the seal is obtained by cooperation between a resilient edge 48 of the piston 20 and the inner wall of the cylinder 18.

The resilient edge 48 of the piston 20 is obtained with a radial notch 49 in the plastic material forming the piston 20, so that a wall is produced which becomes progressively thinner until it reaches very small values; the diameter of the resulting upper lip of the wall of the piston is little greater than the inner diameter of the cylinder 18.

An intermediate valve 39 (FIGS. 5 and 6) may be included in an embodiment of the invention. This intermediate valve serves to retain the fluid under pressure in the storage chamber 27 for enough time for the piston 20 to leave its upper dead center position and for the expansion of the fluid to take place only during the descent phase of the piston and therefore during the phase of productive work of the latter. This intermediate valve 39 may be positioned in various ways.

Figure 5:
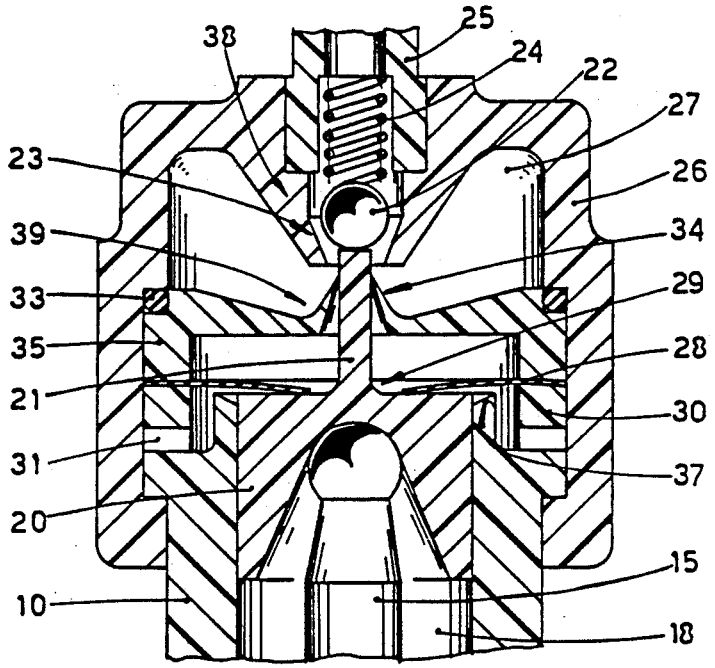

FIG. 5 provides a support disk 35 with a sealing ring 33. The support disk 35 comprises at its center in cooperation with the projecting rod 21 a hollow cone 34, which shuts off or reduces substantially the passage of fluid about the projecting rod 21 so long as the rod 21 is cooperating with the top of the hollow cone 34.

Figure 6:
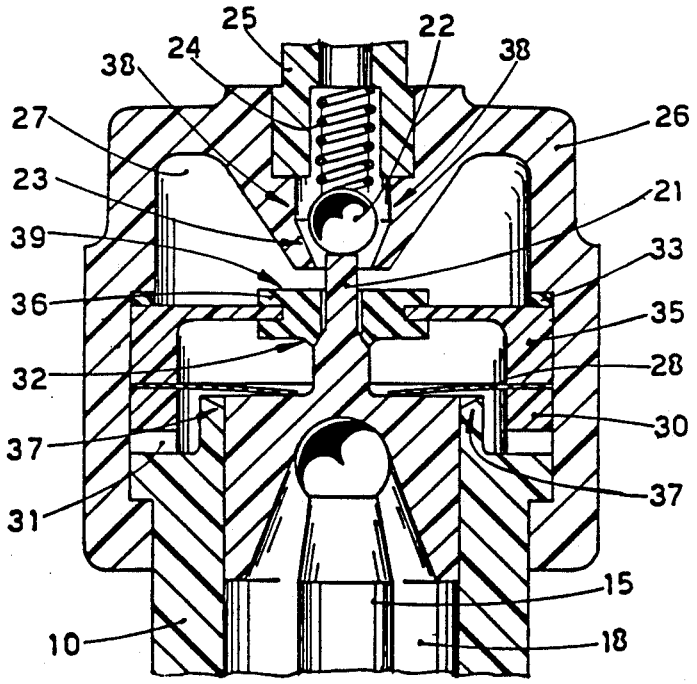

In FIG. 6 the support disk 35 comprises a ring 36 consisting of a soft resilient material, whereas the projecting rod 21 includes a tapered closure portion 32. So long as the tapered portion 32 acts on the central hole of the ring 36, a fluid-tight seal is obtained.

The above shows that the small-sized engine of the invention, in contrast to the known art of small engines, has its discharge valve open during the whole phase of re-ascent of the piston 20 and therefore its efficiency is better than that of types of engines known in the art owing to its elimination of compression during the re-ascent phase of the piston.

We claim:

1. A small-sized engine operated by an expanding gaseous fluid, comprising:

a cylinder;

a piston within said cylinder, having an upper surface which defines an expansion chamber in the cylinder;

an output shaft rotatably secured to and driven by the piston;

inlet valve means for introducing fluid into the expansion chamber; and a perforated, resilient membrane in the expansion chamber, circumferentially secured to the cylinder, said piston engaging with and disengaging from said membrane during operation of the engine, said membrane temporarily functioning as a pneumatic seal, by resilient deformation of the membrane, during operation of the engine.

2. The engine of claim 1, further comprising discharge passages in the expansion chamber on the same side of said membrane as said piston, said cylinder comprising an engaging surface for engaging with and disengaging from said membrane during operation of the engine, the operation including an expansion phase, said discharge passages being closed by the engaging of the membrane and the engaging surface during the expansion phase of the fluid during operation of the engine.

3. The engine of claim 1, wherein the piston is provided with radial notches for discharging expanded fluid, said notches being temporarily closed by the engaging of the membrane and the piston during operation of the engine.

4. The engine of claim 1, wherein the membrane is of nonplanar form in its relaxed position, having a middle portion which is closer to the upper surface of the piston than an edge portion is.

5. The engine of claim 1, further comprising a storage chamber in communication with the inlet valve means, the membrane being between the storage chamber and the piston.

6. The engine of claim 1, further comprising an automatic discharge valve on the upper surface of the piston, the piston being provided with slots which are opened and closed by the automatic discharge valve during operation of the engine.

7. The engine of claim 6, wherein the automatic discharge valve comprises a plate, a hollow rod extending from the plate and engaging a pin having a retaining head, said pin being secured to the piston, and means for resiliently urging the plate away from the piston.

8. The engine of claim 1, wherein the piston comprises a circumferential notch and an outer sealing lip.

9. The engine of claim 5, further comprising intermediate valve means between the expansion chamber and the storage chamber, said intermediate valve means closing before opening of the inlet valve means and opening after the piston leaves its upper dead center position.

10. The engine of claim 9, wherein the intermediate valve means is located between the membrane and the storage chamber.

11. The engine of claim 10, wherein the piston comprises a rod for closing the intermediate valve means.

* * * * *